United States Patent [19]

Blackwell et al.

[11] Patent Number: 4,830,103

[45] Date of Patent: May 16, 1989

[54] SETTING TOOL FOR MECHANICAL PACKER

[75] Inventors: Henry W. Blackwell, Venus, Tex.; Clifford L. Talley, Hobbs, N. Mex.; Rodger D. Lacy, Midland, Tex.

[73] Assignee: Dresser Industries, Inc., Dallas, Tex.

[21] Appl. No.: 180,488

[22] Filed: Apr. 12, 1988

[51] Int. Cl.[4] ..... E21B 23/06

[52] U.S. Cl. ..... 166/387; 166/123; 166/124; 166/182

[58] Field of Search ..... 166/123, 124, 134, 181, 166/182, 382, 387

[56] References Cited

U.S. PATENT DOCUMENTS

| | | | |
|---|---|---|---|
| 3,483,921 | 12/1969 | Berryman | 166/124 X |
| 3,746,093 | 7/1973 | Mullins | 166/123 |
| 4,565,247 | 1/1986 | Tapp et al. | 166/123 |
| 4,690,220 | 9/1987 | Braddick | 166/124 X |

*Primary Examiner*—William P. Neuder

*Attorney, Agent, or Firm*—Edward G. Fiorito; William R. Peoples; Roy L. Van Winkle

[57] ABSTRACT

A packer setting tool is disclosed for providing quick and reliable release thereof from a well casing packer. The setting tool is adapted for lowering the packer assembly within the casing. The setting tool is rotated by a drill string to release an upper set of packer assembly slips into engagement with the well casing. The packer setting tool is then lifted, thereby deploying a rubber sealing boot and setting the upper and a lower set of slips into permanent engagement with the casing. The packer setting tool is then again rotated, whereupon a shear connection is released and the setting tool can be removed from the packer and out of the well bore.

13 Claims, 4 Drawing Sheets

SETTING TOOL FOR MECHANICAL PACKER

RELATED APPLICATION

"Method for Installing A Liner Within A Well Bore," by Blackwell, et al., Ser. No. 180,778, filed concurrently herewith, Attorney's docket No. OT-88-2.

TECHNICAL FIELD OF THE INVENTION

The present invention relates in general to well casing packers, and more particularly to apparatus and methods for setting such packers within the well casing.

BACKGROUND OF THE INVENTION

Packers are commonly employed for isolating sections of a perforated well casing adjacent oil producing formations. By isolating sections of a well casing between hydrocarbon producing formations, other depleted formations can be separated therefrom. Packers are also utilized to isolate sections of well casings to enable injection of fluids into selected formations, while isolating other formations.

Currently available casing packers typically include a tubular section with an elastomeric boot disposed therearound so that when radially expanded, a seal is effected within the casing. Such a packer is thus effective to isolate the casing into two sections. The packer itself is generally fixed within the casing by employing a number of toothed slip members which are wedged between the packer tubular section and the well casing. An upper and lower set of slips are generally utilized, one having teeth oriented to prevent downward movement of the packer, and the other having teeth oriented in another direction to prevent upward movement of the packer.

Well casing packers are constructed for setting, or otherwise being fixed in a well casing by various techniques. For example, certain packers, known as "wire-line packers", are set by way of an electric wire-line which extends from the packer apparatus to the surface. By energizing the wire-line, a power charge is ignited and the packer is tripped so that the slips engage the casing, thereby setting the packer. Because of the general construction of such type of packers, only a modest amount of equipment can be supported therefrom as the packer is lowered into the well bore. Normally, a wire-line packer can support about 2,500 pounds of equipment suspended therefrom running it into the well bore.

Hydraulic packers are available which are set with the use of pressurized hydraulic fluid. Some types of hydraulic packers can even be released by pumping a different fluid pressure downhole to the packer assembly. The disadvantage with the wire-line and hydraulic type of packers is that expensive surface equipment is required. Particularly, electric wire-line dispensing trucks and heavy duty hydrauilc pumping equipment are required to operate these packer assemblies.

Permanent or drillable packers are another type of packer equipment which are set and permanently fixed within a casing. The drillable packers require additional downhole apparatus for setting the slips within the casing, but can support several hundred thousand pounds of equipment therefrom when running such apparatus into well bore.

It can be appreciated that the operation of packers must be extremely reliable, otherwise the retrieval thereof from a casing several thousand feet deep may be extremely time consuming and expensive. In setting a mechanical packer, a drill string is often utilized in the setting process, and thereafter disconnected from the packer and removed. When a packer is utilized in conjunction with a well casing cementing operation, it is imperative that the drill string be completely disconnected from the packer, otherwise the entire drill string would be fixed within the well bore when the cement solidifies.

From the foregoing, it can be seen that a need exists for improved packer setting apparatus which can reliably set a mechanical packer within a casing, and be quickly and reliably released therefrom. An associated need exists for a technique in which a packer can be set and released without resorting to surface equipment which otherwise would not be required.

SUMMARY OF THE INVENTION

In accordance with the invention, there is disclosed a drillable packer construction which substantially reduces or eliminates the shortcomings and disadvantages of the prior art packers. The drillable packer of the invention is constructed so that various rotational and axial movements of the drill string are effective to set the packer and deploy a sealing elastomer to the casing, as well as release the packer from the drill string.

In accordance with the preferred embodiment of the invention, a drill string setting tool is releasably connected to a packer assembly so that it can be lowered in the casing to the proper depth. Friction springs are fastened to the setting tool for centering it as it is lowered in the casing, as well as to prevent rotation of the spring and anchor cage and a slip-cover sleeve during packer setting. The drill string is then rotated, wherein the threaded slip-cover sleeve moves axially upwardly and allows a number of upper toothed slips to be released into engagement with the casing. The packer setting tool is then lifted upwardly an amount sufficient to wedge the upper slips, as well as to wedge a number of lower toothed slips into gripping engagement with the casing. The upward movement of the setting tool also expands an elastomeric boot to effect a seal of the packer assembly to the casing. A ratcheting arrangement maintains the packer slips wedged to the casing, as well as maintains the sealing boot expanded against the casing. The packer is then tightly and permanently wedged within the casing and resists any movement thereof.

Next, the drill string is rotated again, whereupon a shearable connection between the setting tool and the packer assembly is released, thereby allowing the setting tool to be quickly and efficiently withdrawn from the casing.

In the preferred form of the invention, a packer assembly slip-cover sleeve is threadably engageable with a threaded ring which rotates in response to the rotation of the drill string. On a number of rotations, the cover sleeve moves sufficiently axially such that the upper slips are released, even though the threaded engagement between the threaded ring and the cover sleeve may remain intact. To that end, the cover sleeve includes a number of longitudinal slits in the sidewall thereof to allow slight radial deformation. Hence, an upward pull on the packer setting tool is effective to disengage the few engaged threads by the slight outward deformation of the cover sleeve sidewall. The complete and reliable separation of the packer and setting tool are thereby ensured. The packer of the invention can be advantageously employed in casing cementing operations where the reliable release of the setting tool is mandatory.

BRIEF DESCRIPTION OF THE DRAWINGS

Further features and advantages will become more apparent from the following and more particular description of the preferred embodiment of the invention, as illustrated in the accompanying drawings in which like reference characters generally refer to the same or similar parts through the views, and in which.

DETAILED DESCRIPTION OF THE INVENTION

Figure 1:
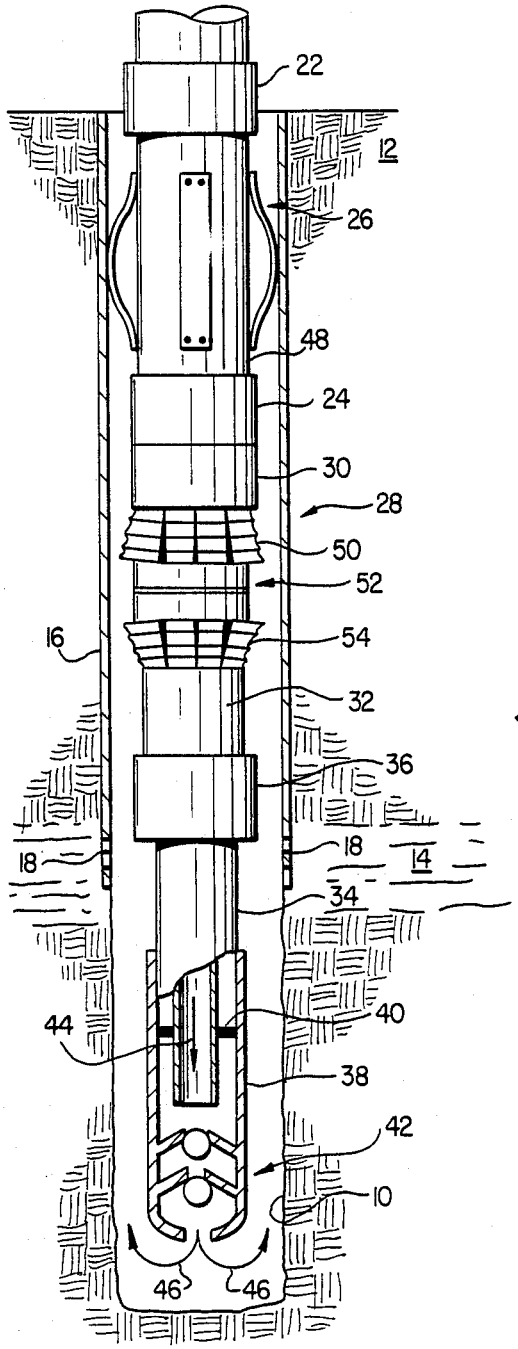
FIG. 1 is a side elevational view of a cased well bore having situated therein the packer and setting apparatus of the invention, as utilized in a cementing operation.

FIG. 1 illustrates an application in which the invention may be advantageously practiced. However, it should be appreciated that the invention may be readily adapted by those skilled in the are for use in many other applications.

Illustrated is a well bore 10 drilled within the earth's crust 12 through a hydrocarbon producing formation 14. The well bore 10 is preferably lined, at least partially, with a casing 16 for providing integrity to the well bore and preventing it from caving in or otherwise deteriorating. The casing 16 may be perforated 18 at vertical depths aligned with the hydrocarbon producing formation 14. As can be appreciated, such a hydrocarbon formation 14 may be located many thousands of feet below the surface of the earth.

In order to install a packer within the casing 16, such apparatus must be lowered to the appropriate depth within the casing 16 by plural sections of drill pipe, a bottom section shown as reference character 20. A coupling 22 provides a threaded connection between the lowermost drill pipe 20 of the drill string and a packer setting tool 24. The packer apparatus includes, among other elements, a friction spring and anchor cage 26, a packer assembly 28 itself, and a packer releasing tool 30. In the example, a seal bore extension 32 is connected to the bottom of the packer equipment. The seal bore extension 32 is connected to a fiberglass tubing liner 34 through a swivel coupling 36. A bottom seal bore 38 is fixed to the fiberglass liner 34, and includes a cement tubing seal 40. A pair of check valves 42 are provided as the bottomost elements to prevent cement or other fluids from reversing direction, once pumped downhole. Two check valves are provided for purposes of redundancy to improve the reliability of the cementing operation.

The general function of the invention is briefly described as follows. Once the fiberglass lining apparatus, the packer and the setting tool have been assembled at the surface, starting with the bottommost components first, the unit is lowered into the casing 16 by the drill string 20 to the desired depth. Cement, or another solidifying material, is then pumped down the drill string 20 through the packer assembly 28 and the check valves 42, as shown by arrows 44. As noted, the check valves 42 prevent the up-flow of the cement once it is pumped into the annulus area surrounding the entire tubular structure. The cement flows upwardly in the annulus of the well bore, as noted by arrows 46. A predetermined volume of cement is pumped down the drill string 20, followed by water, so that the cement rises in the annulus to the point above the packer assembly 28. The water clears substantially the entire inner volume of the tubular structure of cement.

Shortly after the cement has been pumped downhole by the surface equipment, the drill string 20 is rotated, which also rotates a packer setting stem 48. Due to the engagement of the friction springs 26 with the casing 16, the springs and the associated spring cage do not rotate. However, by rotating the drill string 20, an upper set of toothed slips 50 is released, and fall outwardly and into engagement with the inside surface of the casing 16. Once the upper slips 50 have been deployed, the drill string 20 is raised a certain distance. The raising of the drill string 20 raises a bottom portion of the packer assembly 28 for deploying an elastomeric boot 52 to effect a seal to the internal sidewalls of the casing 16. A bottom set of toothed slips 54 is also deployed into a gripping relationship with the casing sidewall. The elastomeric boot 52 displaces a portion of the cement to achieve a high quality seal with the casing 16. Simultaneous with the deployment of the elastomeric boot 52, a wedge mechanism on the packer wedges the upper slips 50 into permanent engagement with the casing 16, as is the case with the bottom set of slips 54. The packer assembly 28 is thereby permanently fixed within the casing 16. Due to the firm engagement of the toothed upper and lower slips 50 and 54 with the casing 16, several hundred thousand pounds of equipment can be suspended by the packer unit 28 within the casing 16.

Once the packer is set in the casing 16 as noted above, the packer assembly 28 cannot be rotated. However, according to a technical advantage of the invention, the packer assembly 28 includes a quick release mechanism 30 which is responsive to a subsequent rotation of the drill string 20 for releasing the setting tool 24 from the packer assembly 28. Once the drill string 20 has been rotated a second time, a connection between the setting tool 24 and the packer assembly 28 is sheared, whereupon the drill string 20, the setting tool 24 and the friction spring and cage apparatus 26 can be removed from the casing 16. The packer setting operation, and its release from the setting tool 24, can be accomplished in a matter of minutes before the cement begins to set.

As noted above, a second liquid is pumped down the drill string 20 to force the liquefied cement yet remaining within the packer assembly 28 and fiberglass liner 34 out into the annulus above the packer assemby 28 and upwardly toward the surface. As a result, the internal bore of both the packer assembly 28 and liner 34 is cleaned, and the cement is allowed to set and harden in the well bore annulus. Subsequent to the foregoing, bore hole firing apparatus can be lowered into the area of the fiberglass liner 34 for reopening lateral areas to access the hydrocarbon producing formation, such as illustrated by reference character 14. From the foregoing, it can be appreciated that a reliable and expendient disconnect of the packer assembly 28 is required to prevent the entire drill string from being captured many thousands of feet downhole. As noted above, if such an event occurred, expensive and time-consuming efforts would need to be undertaken to cut the drill string at the packer location, clean out the well bore, and commence activities.

Having described the general construction and operation of the invention, reference is now made to FIGS. 2a-2d where there are shown the details of the packer setting tool 24 and the packer assembly 28 itself. The drill string 20 is coupled, via the coupling 22 to the packer setting tool stem 48. Surrounding the upper portion of the setting tool stem 48 are a number of friction springs 60 which are adapted to bow outwardly in engagement with the casing 16. The friction springs 60 are fixed at one end thereof by screws 62 to an anchor cage 64. The other end of the friction springs 60 are captured within slots 66 of the anchor cage 64 for enabling the springs 60 to frictionally conform to the internal surface of the casing 16. The anchor cage 64 is threadably connected to a slip-cover sleeve 68. With this construction, when the drill string 20 is rotated, the springs 60, anchor cage 64 and slip-cover sleeve 68 do not rotate. The slip-cover sleeve 68 surrounds the lower portion of the setting tool stem 48. In addition, the slip-cover sleeve 68 includes on an internal surface thereof a number of right-hand threads 70. Formed through the sidewalls of the slip-cover sleeve 68 are a number of slits 72 for allowing slight radial deformation of the sleeve 68. The slip-cover sleeve 68 is threadably connected to a threaded ring 74 which is carried by the tubular body of a packer mandrel 76. The packer mandrel 76 generally defines a tubular body for providing a central fluid conduit through the packer assembly 28, when such assembly is set within the casing 16. A number of elements or components are fixed or otherwise arranged around the tubular body of the packer mandrel 76.

Figure 3:
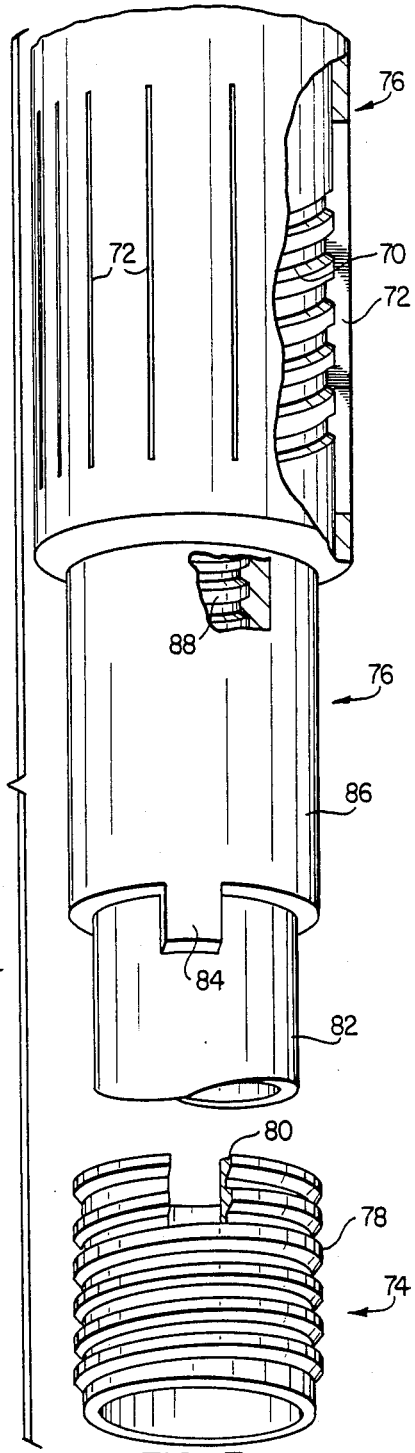
FIG. 3 is an exploded view of several parts of the packer assembly operative to achieve a quick and efficient release of the setting tool therefrom.

The engaging relationship between the packer mandrel 76 and the threaded ring 74 is shown in more detail in FIG. 3. The threaded ring 74 includes a number of external threads 78 which are generally not square, but rather have slightly tapered edges, for a purpose to be described below. Further, the threaded ring 74 includes a key or lug notch 80 formed or otherwise milled into an upper edge thereof. The threaded ring 74 freely rotates on a reduced diameter portion 82 of the packer mandrel 76, except when the notch 80 is engaged with a corresponding sized lug 84 machined from an increased diameter part 86 of the packer mandrel 76. Hence, when the ring 74 is locked to the packer mandrel 76, via the lug 84 and the notch 80, the ring 74 is carried with the mandrel 76 during rotation thereof. The upper part of the mandrel 76 has internal threads 88, of left-hand orientation.

Figure 2A:
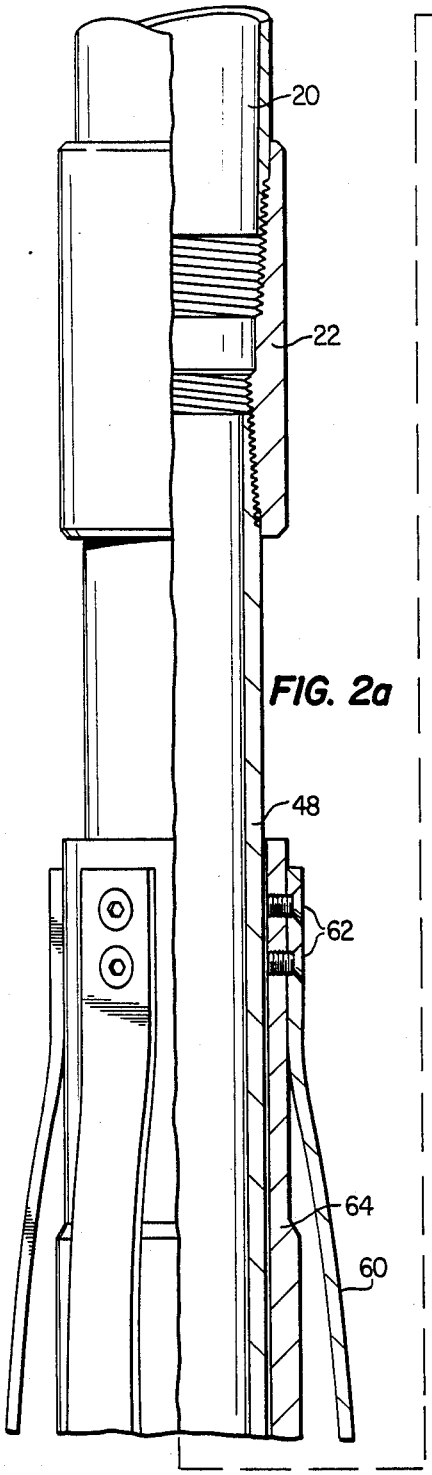
FIGS. 2a–2c, when joined together, are partial sectional views of the packer and setting apparatus according to the preferred form of the invention.
Figure 2B:
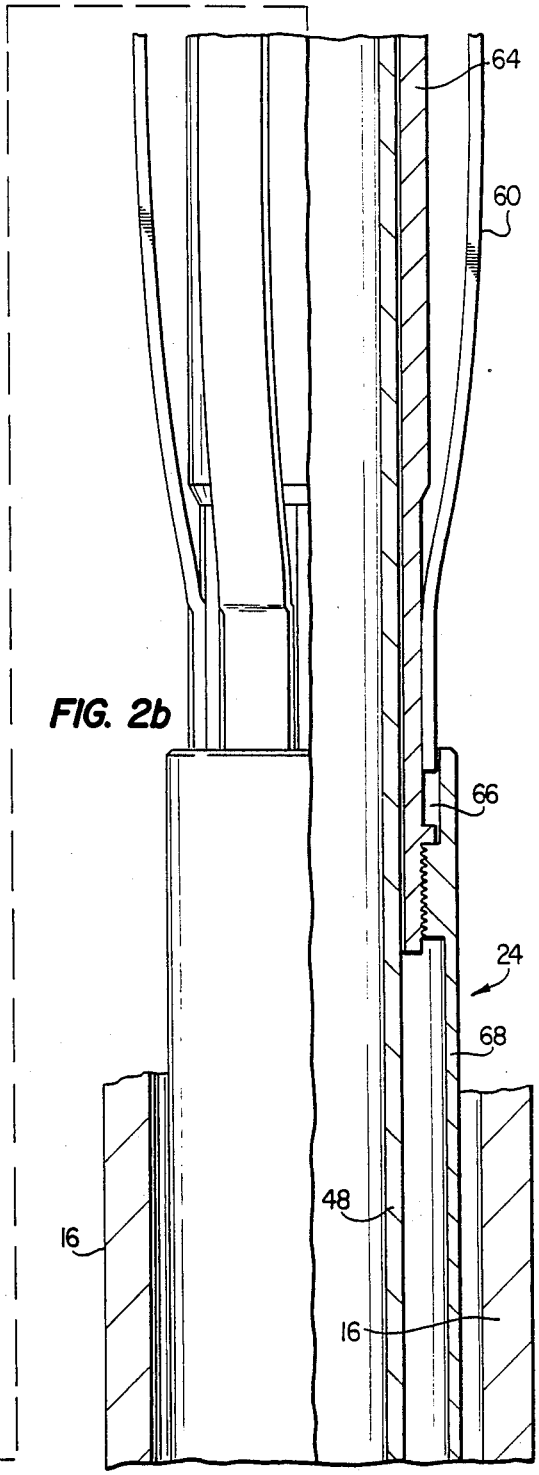
Figure 2C:
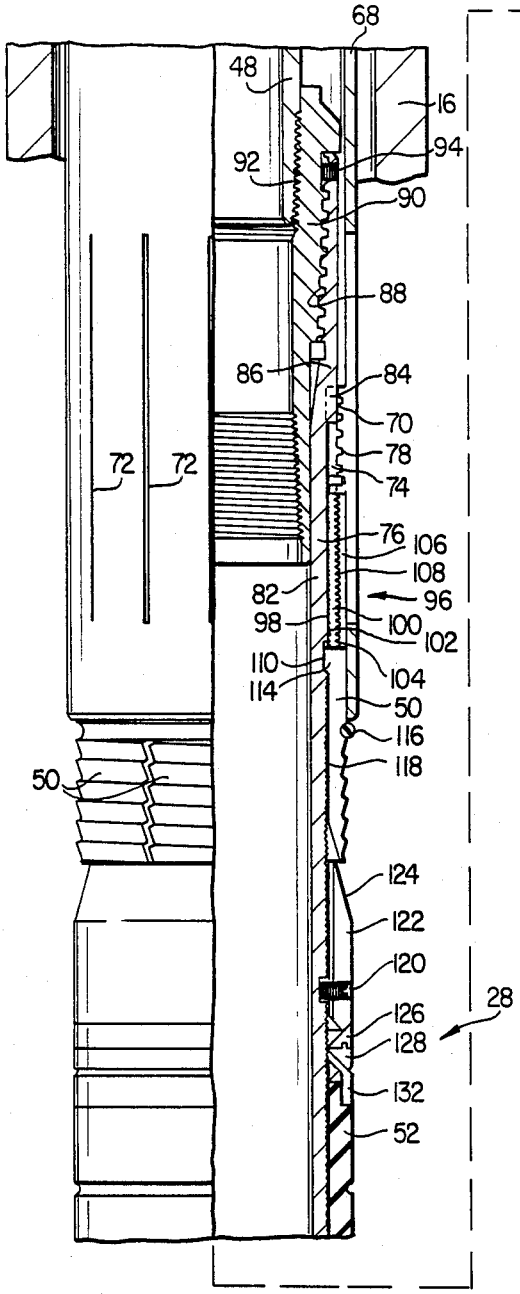
Figure 2D:
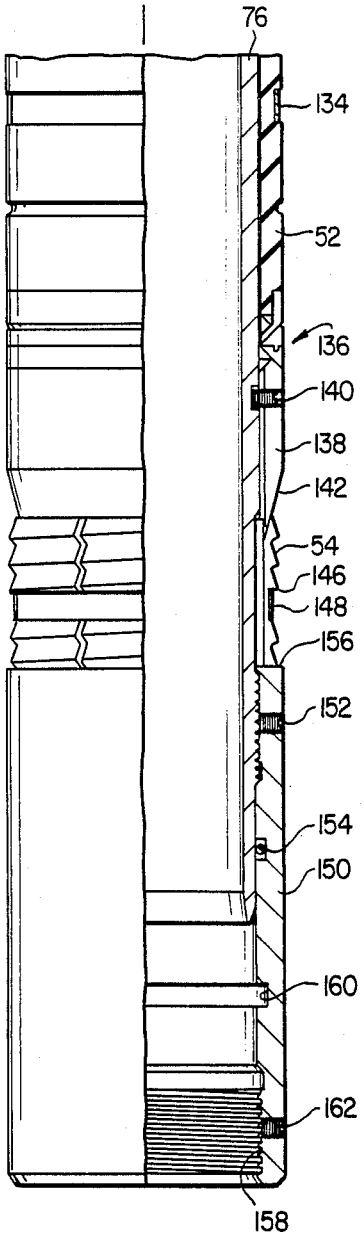

The threaded part of the mandrel is threadably engaged by a coupling 90 (FIG. 2*c*to the packer setting stem 48. The threaded connection between the packer setting stem 48 and the coupling 90 is by right-hand threads 92. Moreover, the left-hand threaded connection between the coupling 90 and the tubular mandrel body 76 is shearably fixed by one or more brass shear screws 94. The shear screws 94 mechanically fix the coupling 90 to the mandrel 76 until the requisite shear force is achieved, whereupon the stem 48 and associated coupling 90 can be separated from the packer assembly 28 by the right-hand rotation of the drill string 20.

With reference again to FIG. 2*c*, a mandrel ratch mechanism 96 is arranged around the reduced diameter portion 82 of the mandrel body 76. The outer surface of the reduced diameter part 82 of the mandrel body 76 includes a number of downwardly oriented teeth 98 encircling the mandrel 76. A first ratchet ring 100, of the split type, includes on an internal surface thereof upwardly oriented teeth 102 for engaging the mandrel body teeth 98. On an outer surface of the first ratchet ring 100 are other upwardly directed teeth 104. A second ratchet ring 106 has on its inner surface thereof downwardly directed teeth 108 for engaging the outer teeth 104 of the first ratchet ring 100. The outer surface of the second ratchet ring 106 is smooth and fits inside of an internal cylindrical surface of the slip-cover sleeve 68.

Formed further down on the tubular mandrel body 76 is an external annular groove 110 in which an upper portion of a plurality of upper toothed slips 50 are seated. Each slip 50 includes an inwardly directed protrusion 114 which fits within the mandrel annular groove 110 so that such slip 50 cannot move downwardly when confined around the outer surface of the tubular mandrel body 76. As noted, and after initial assembly of the packer assembly 28, the slip-cover sleeve 68 covers at least a portion of the slips 50 to keep such slips arranged closely around the mandrel body 76 and prevent them from being inadvertently deployed. This prevents the packer assembly 28 from being engaged with the casing 16. In addition, a continuous O-ring 116 encircles the slips 50 to maintain such slips generally arranged in an ordered manner around the packer assembly 28, especially when initially released for gripping engagement to the casing 16.

The outer surface of the mandrel body 76 also includes downwardly oriented annular teeth 118 to maintain engagement of the slips 50 to the packer when subsequently set and fixed to the casing 16. Fixed directly below the upper slips 50 to the mandrel body 76 by a shearable screw connection 120 is an upper head 122 with an upper angled surface 124. The head 122 is effective, when shearably released from the mandrel body 76, to move upwardly and wedge the upper slips 50 into a first and reliable grip to the casing 16. As noted by the orientation of the teeth of the slip 50, upper movement of the packer assembly is prevented when set within the casing 16.

A pair of annular expansion rings 126 and 128 are held together by a tongue-and-groove connection, and function to separate the upper annular head 122 from an elastomeric boot 52 situated therebelow. The upper edge of the boot 52 includes an annular angled element 132 which fits under the expansion ring 128. With such an arrangement, the upper edge of the elastomeric boot 52 is maintained engaged around the tubular mandrel body 76 during axial compression to effect deployment of the boot 52. The elastomeric boot 52, when deployed, expands outwardly to provide a seal between the packer mandrel body 76 and the inside surface of the casing 16. A metal constriction band 134 encircles the elastomeric boot 52 and prevents a central circumferential portion thereof from expanding outwardly. Thus, when axially constricted, the rubber boot 52 deploys outwardly at two sections, one above the constriction ring 134, and one below the constriction ring 134.

The lower end of the elastomeric boot 52 is maintained engaged around the tubular mandrel body 76 by a similar set of expansion rings 136. A lower head 138 is fixed around the mandrel body 76 by one or more shear screws 140. The lower end of the head 138 includes a beveled surface 142 which is slideable under a lower set of slips 54 for wedging such lower slips in a firm gripping engagement with the inside surface of the casing 16. The lower slips 54 have teeth 146 angled downwardly to prevent the packer assembly 28 from being pulled downwardly, once such assembly is set within the casing 16. A breakable metal band 148 maintains the plural lower slips 54 generally arranged around the tubular mandrel body 76 during deployment.

The lower end of the tubular mandrel body 76 is threadably connected to a bottom nipple 150. In addition, a number of set screws 152 prevent inadvertent rotation of the bottom nipple 150 with respect to the tubular mandrel body 76. An O-ring 154 provides a fluid seal between the tubular mandrel body 76 and the bottom nipple 150. The bottom nipple 150 includes an upper shoulder surface 156 on which the bottom set of slips 54 rest.

Once lowered to the proper depth in casing 16, the deployment of the lower slips 54, the elastomeric boot 52 and the upper slips 50 is accomplished as follows. The drill string 20 is pulled or raised upwardly, thereby carrying with it the setting tool stem 48, the coupling 90 and the tubular mandrel body 76. As a result, the bottom nipple 150 is also moved upwardly which shears the upper head set screws 120 and breaks the metal band 148 around the lower slips 54. As a consequence the lower slips 54 are forced onto the ramped edge 142 of the lower head 138. This, in turn, forces the lower head 138 upwardly which shears the screws 140, and which then forces the elastomeric boot 52 upwardly also. The upward movement of the elastomeric boot 52 applies a force on the upper head 122 which forces the upper slips 50 into a firm grip with the casing 16. Of course, before deployment of the noted elements, the upper slips 50 have been released, i.e., are no longer engaged around the tubular mandrel body 76 by the slip-cover sleeve 68. With the continued upward movement of the nipple 150, the upper and lower slips 50 and 54 are forced outwardly into a firm gripping relationship with the casing 16. The general axial force applied between the ends of the elastomeric boot 52 causes it to bow outwardly on each side of the constriction band 134. The elastomeric boot 52 expands outwardly sufficiently such that it presses against the internal sidewalls of casing 16, thereby effecting a seal to the casing 16 and defining isolated upper and lower zones within the casing 16. When sealed, fluid is able to be pumped through the packer assembly 28 via the tubular mandrel. When the packer is set in the noted manner, it cannot be moved upwardly or downwardly, or rotated.

The nipple 150 includes internal threads 158 for attaching other equipment thereto. In addition, an internal annular groove 160 is provided for receiving an O-ring (not shown) for sealing such other equipment therein. Optional set screws may be utilized in the threaded hole 162 for fixing other equipment, such as the seal bore extension 32 (FIG.1) to the packer assembly 28.

The packer setting apparatus and the packer assembly itself may be utilized in conjunction with the cementing operation noted above, or may be utilized in other applications for isolating zones within a casing 16. In such applications, the packer can be set, and the setting tool removed therefrom, by the operations described below. First, the packer setting tool 24 and the packer assembly 28 are lowered to the proper depth within the casing 16, via the drill string 20. The friction springs 60 are constructed to exert a force on the sidewalls of the casing 16 sufficient to require a force of about 400–500 lbs. to move the packer assembly 28 within the casing 16. Importantly, the friction springs 60 grip the inside of the casing 16 and thus resist attempts to rotate the anchor cage 64 and friction springs 60.

Once the packer assembly 28 is located at the proper depth within the casing 16, the drill string 20 is rotated in a right-hand direction, which angular movement rotates the setting tool stem 48. The rotational movement of the setting tool stem 48 is translated through the coupling 90 to the tubular mandrel body 76 which is fixed thereto by the set screw 94. The right-hand rotation of the drill string 20 is in a direction which tightens the right-hand threads 92. No relative movement occurs with respect to the left-hand threads 88, as the tubular mandrel body 76 is fixed to the coupling 90 via the shearable set screw 94. Insufficient force is exerted on the set screw 94, at this time, for any shearing action to occur.

The rotational movement of drill string 20, and thus the tubular mandrel body 76, causes corresponding rotation of the threaded ring 74, due to its engagement by way of the notch 80 and the key lug 84. Accordingly, the rotation of the threaded ring 74 causes a coaction between its threads 78 and those 70 of the slip-cover sleeve 68. The slip-cover sleeve 68, the attached anchor cage 64 and friction springs 60 do no rotate and thus move upwardly with respect to the tubular mandrel body 76. After a number of rotations of the drill string 20, the slip-cover sleeve 68 is moved upwardly sufficiently such that the bottom portion thereof uncovers the upper slips 50. Preferably, the slip-cover sleeve 68 is moved upwardly sufficiently to become completely disengaged from its threaded connection with the threaded ring 74. However, if such a complete disconnection is not effective during rotation, the parts are separated by a subsequent action described below.

Once the upper slips 50 are deployed, they fall downwardly into engagement with the casing 16. The next action in setting the packer equipment of the invention is the upward movement of the drill string 20, thereby also moving the tubular mandrel body 76 upwardly. The nipple 150 is carrier upwardly by the mandrel body 76 and forces the lower slips 54 upwardly also. As noted above, the depolyment of the lower slips 54 and the elastomeric boot 52 is achieved by the upward movement of the nipple 150. Because the upper slips 50 cannot move upwardly, primarily due to the engagement thereof with the casing 16, the intermediate components therebetween are forced together. The lower slips 54 are thereby wedged by the lower head 138 into gripping engagement with the casing 16, as are the upper slips 50 as a result of the wedging action with the upper head 122. As noted above, the constriction also deploys the elastomeric boot 52 outward into a sealing relationship with the casing 16. The packer apparatus is thereby permanently set within the casing 16 with the elastomeric boot 52 forming a seal to define two fluid tight zones within the casing 16.

Once the packer assembly is set, the setting tool 24 must be released therefrom and retrieved or removed from the casing 16. In order to accomplish this, the tubing string 20 is again rotated in a right-hand direction. However, during the second rotation of the drill string 20, the packer assembly 28 is set and cannot turn, and thus the shear screw 94 between the coupling 90 and the tubular mandrel body 76 is sheared. The right-hand rotation of the setting tool stem 48 is effective to unscrew the left hand threads of the coupling 90 from the upper part of the tubular mandrel body 76. The drill string 20 is then lifted further, in which event the upper shoulder of the coupler 90 engages a lower shoulder of the anchor cage 64, thereby lifting the apparatus attached thereto.

As noted above, the slip-cover sleeve 68 is fixed to the anchor cage 64 and is removed from the casing 16 also. However, should the threaded ring 74 remain engaged by a few threads with the threads 70 of the slip-cover sleeve 68, the complete upward removal of the packer setting tool 24 is prevented. Preferably, the threaded engagement between the slip-cover sleeve 68 and the packer mandrel 76 must be greater in length than the distance the slip-cover sleeve 68 extends over the upper slips 50. Otherwise, it would be possible that the upper slips 50 could not move down and wedge between the upper head 124 and the casing 16. In accordance with an important feature of the invention, the slip-cover sleeve 68 is provided with a number of slits 72 to allow slight radial outward deformation thereof. Thus, with an upward movement of the slip-cover sleeve 68, a central section thereof is flexed outwardly by the engagement with the threaded ring 74, whereby the sleeve threads 70 slip over the threads 78 of the ring 74, and the parts are separated. The tapered threads of both the threaded ring 74 and the slip-cover sleeve 68 facilitate the axial disengagement of such parts. It can be appreciated that the threads are not sheared or stripped, as it would require an enormous force for such action. After the slip-cover sleeve 68 is completely separated from its threaded engagement with the threaded ring 74, further upward movement of the drill string 20 is effective to remove the packer setting tool 24, the friction spring anchor assembly 26 and the slip-cover sleeve 68 from the well bore.

Figure 4:
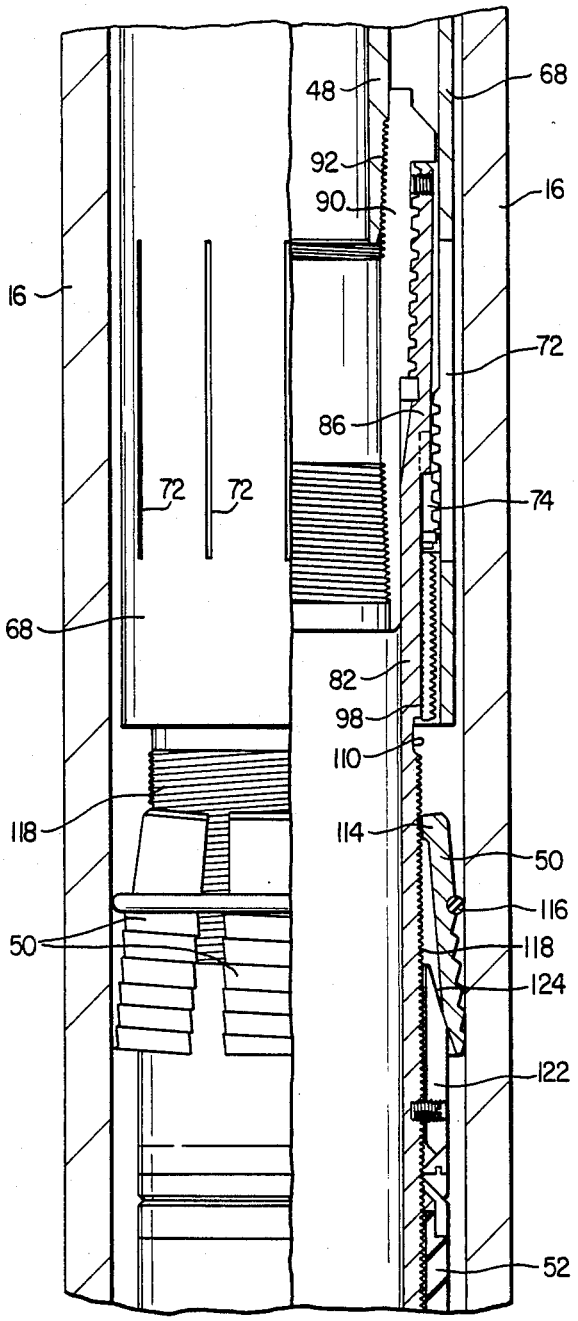
FIG. 4 is a partial sectional view of the packer assembly lowered within a casing, just before removal of the setting tool therefrom and before the slips are fully set.

FIG. 4 illustrates an enlarged section of FIG. 2*c*, particularly the relationship of the packer parts after deployment of the upper slips 50, and in the event a threaded engagement still exists between the slip-cover sleeve 68 and the threaded ring 74. Further rotational movement of the setting tool stem 48 is ineffective to rotate the threaded ring 74 with respect to the slip-cover sleeve 68, as the second upward movement of the drill string 20 causes the mandrel lug 84 to be completely removed from the notch 80 of the threaded ring 74.

While the packer setting tool 24 and the packer assembly 28 itself can be utilized for isolating zones within a well casing 16, such apparatus is also well adapted for the installation of a well bore liner. A fiberglass liner can be attached to the packer assembly 28 and set within the bottom of a well bore with cement. The technical advantage of utilizing a packer seal together with a cemented well bore annulus provides a high degree of strength and a high quality fluid seal within the casing. The use of a fiberglass liner with the packer of the invention is described in the related application identified above, the disclosure of which is incorpoated in its entirely herein by reference.

From the foregoing, it can be seen that an improved packer setting tool is disclosed for quickly and efficiently setting a packer assembly, as well as for reliably and effectively being removed therefrom.

While the preferred embodiment of the invention has been disclosed with reference to a specific apparatus and application, it is to be understood that many changes in detail may be made as a matter of engineering choices without departing frm the spirit and scope of the invention, as defined by the appended claims.

What is claimed is:

1. Apparatus for setting packer equipment in a well casing, comprising:

a tubular setting tool connectable to drill string;

a tubular packer mandrel having a reduced diameter part and internal threads formed on an upper end thereof, said mandrel further including a lug adjacent said reduced diameter part;

a coupling member fixed to said tubular setting tool and shearably fixed to said packer mandrel;

a ring member having threads and slideable on the reduced diameter part of said packer mandrel, said ring further including a notch for receiving said mandrel lug so that rotation of said packer mandrel also rotates said ring;

a plurality of toothed slips arranged around said packer mandrel, said slips each being adapted for engaging with the well casing;

an elastomeric boot encircling said packer mandrel and adapted for deforming outwardly in a sealing engagement with the casing;

a cylindrical cover sleeve surrounding said tubular packer mandrel and adapted for at least partially covering said slips for maintaining said slips arranged around said mandrel, said cover sleeve having threads engageable with the threads of said ring, and further including a plurality of slits for allowing radial yielding thereof in an area adjacent the sleeve threads; and spring engaging means fixed to said cover sleeve to prevent rotational movement of said sleeve with respect to the casing.

2. The apparatus of claim 1, further including means responsive to an axial movement of said setting tool for setting said slips in gripping engagement with the casing, and for deforming said elastomeric boot into sealing engagement with the casing.

3. The apparatus of claim 1, further including means responsive to a first rotational movement of said setting tool for rotating said tubular packer mandrel and said threaded ring to thereby axially move said cover sleeve and release said slips.

4. The apparatus of claim 3, further including means responsive to a second rotational movement of said setting tool for shearing a connection between said setting tool and said packer mandrel such that said setting tool can be separated from said packer mandrel.

5. Apparatus for setting packer equipment in a well casing, comprising:

a tubular mandrel insertable into the casing, said tubular mandrel including a key lug;

a plurality of slips, each having a roughened surface for engaging a surface of the casing;

a sleeve at least partially covering said slips for confining the slips around said tubular mandrel, said sleeve having a threaded portion encircling said tubular mandrel and having a key notch therein for receiving said key lug so that when said tubular mandrel is rotated, said threaded portion is also rotated moving said sleeve in an axial direction to uncover the slips, whereby the slips can engage the casing surface.

6. Apparatus for setting packer equipment in a well casing, comprising:

a tubular mandrel insertable into the casing;

a plurality of slips, each having a roughened surface for engaging a surface of the casing;

a sleeve at least partially covering said slips for confining the slips around said tubular mandrel, said sleeve having a threaded portion;

a setting tool operable with said tubular mandrel and including a threaded part engageable with the threaded portion of said sleeve so that when said tubular mandrel is rotated, said sleeve moves in axial direction so as to uncover the slips, whereby the slips can engage the casing surface; and said sleeve also includes means for allowing radial deformation thereof for releasing the threaded engagement of said sleeve from said tubular mandrel.

7. The apparatus of claim 6, wherein said deforming means comprises a plurality of axial slits in said sleeve.

8. Apparatus for setting packer equipment in a well casing, comprising:

a setting tool releasably attachable to a tubular mandrel for lowering a packer assembly into the casing;

a plurality of slips arranged on said packer assembly, each adapted for engaging an inner sidewall of the casing;

an elastomeric boot disposed around said tubular mandrel and adapted for radial displacement to effect a seal to the sidewall of the casing;

a cylindrical sleeve arranged for a threaded engagement with said tubular mandrel and movable from the first position for maintaining said slits not engaged with the casing, to a second position for releasing said slits into engagement with the casing, said sleeve further including a plurality of slits for allowing radial yield thereof, such that the threaded engagement between the sleeve and tubular mandrel can be released on axial movement of said tubular mandrel;

means responsive to a first rotation of said tubular mandrel for moving said sleeve from said first position to said second position for releasing said slits;

means responsive to an axial movement of said tubular mandrel for causing said boot to deform and be sealed to the casing sidewall, and for wedging said slits into engagement with the casing sidewall; and means responsive to a second rotation of said tubular mandrel for releasing said setting tool from said tubular mandrel so that said setting tool can be moved from the casing.

9. Apparatus for setting packer equipment in a well casing, comprising:

a setting tool releasably attached to a tubular mandrel for loading a packer assembly into the casing;

a plurality of slits arranged on said packer assembly, each adapted for engaging an inner sidewall of the casing;

an elastomeric boot disposed around said tubular mandrel and adapted for radial displacement to effect a seal to the sidewall of the casing;

a cylindrical sleeve movable from a first position for maintaining said slits not engaged with the casing, to a second position for releasing said slits into engagement with the casing;

means responsive to a first rotation of said tubular mandrel for moving said sleeve from said first position to said second position for releasing said slits, said means including a threaded ring movable axially on said tubular mandrel and threadedly engaged with said sleeve, said ring being rotatably carried by said tubular mandrel and having a key notch in an end thereof for receiving a key lug on said tubular mandrel so that rotational movement of said tubular mandrel causes said ring to rotate, and axial movement of said tubular mandrel releases said ring from said tubular mandrel lug;

means responsive to axial movement of said tubular mandrel for causing said boot to deform and be sealed to the casing sidewall, and for wedging said slits into engagement with the casing sidewall; and means responsive to a second rotation of said tubular mandrel for releasing said setting tool from said tubular mandrel so that the setting tool can be moved from the casing.

10. A method for setting a packer in a casing comprising the steps of:

attaching a packer assembly to a setting tool;

attaching slits to the packer assembly;

maintaining said slits arranged together with a cover sleeve wherein said slits are arranged around a tubular mandrel and at least partially covered by said cylindrical cover sleeve;

engaging the cover sleeve to the setting tool by a threaded arrangement so that said cover sleeve moves in an axial direction in response to rotational movement of said tubular mandrel;

rotating the tubular mandrel a first time to release the slits for engaging the casing;

constructing said cover sleeve with yieldable sidewalls to effect said disengagement of the threaded arrangement;

pulling up on the tubular mandrel to seal the packer to the casing and to wedge said slits in frictional engagement with the casing;

disengaging the threaded arrangement between the setting tool and cover sleeve by axial movement of the tubular mandrel; and rotating the tubular mandrel a second time to release the packer therefrom so the setting tool can be withdrawn from the casing.

11. The method of claim 10, further including forming a number of slits in the sidewalls of the cover sleeve.

12. A method for setting packer equipment in a well casing, comprising:

releasably attaching a setting tool to a tubular mandrel for lowering the packer assembly into the casing;

arranging a plurality of slits on said packer assembly, each adapted for engaging an inner sidewall of the casing;

disposing an elastomeric boot around said tubular mandrel and adapting said boot for radial displacement to effect a seal to the sidewall of the casing;

moving a cylindrical cover sleeve from a first position for maintaining said slits nonengaged with the casing to a second position for releasing said slits into engagement with the casing;

providing a plurality of slits in said cover sleeve for allowing radial yield thereof, such that a threaded engagement between said sleeve and said tubular mandrel can be released on axial movement of said tubular mandrel;

rotating said tubular mandrel a first time for moving said cover sleeve from said first position to said second position for releasing said slits;

axially moving said tubular mandrel for causing said boot to deform and be sealed to the casing sidewall and for wedging said slits into engagement with the casing sidewall; and rotating said tubular mandrel a second time for releasing said setting tool from said tubular mandrel so that said setting tool can be moved from the casing.

13. A method for setting packer equipment in a well casing, comprising:

releasably attaching a setting tool to a tubular mandrel for lowering the packer assembly into the casing;

arranging a plurality of slits on said packer assembly, each adapted for engaging an inner sidewall of the casing;

disposing an elastomeric boot around said tubular mandrel and adapting said boot for radial displacement to effect the seal to the sidewall of the casing moving a cylindrical cover sleeve from a first position for maintaining said slits nonengaged with the casing to a second position for releasing said slits into engagement with the casing;

providing a threaded ring connected for axial movement relative to said tubular mandrel and threadably connecting said ring with said sleeve, said tubular mandrel having a key lug on one end thereof and said threaded ring having a key notch in the end thereof for receiving said key lug so that rotational movement of said lug causes said ring to rotate and axial movement of said tubular mandrel releases said ring from said tubular mandrel key lug, said ring being rotatably carried by said tubular mandrel so that rotation of said tubular mandrel also rotates said ring, whereby said sleeve axially moves and uncovers said slits;

rotating said tubular mandrel a first time for moving said sleeve from said first position to said second position for releasing said slits;

axially moving said tubular mandrel for causng said boot to deform and be sealed to the casing sidewall, and for wedging said slits into engagement with the casing sidewall; and rotating said tubular mandrel a second time for releasing said setting tool from said tubular mandrel so that said setting tool can be moved from the casing.

* * * * *

UNITED STATES PATENT AND TRADEMARK OFFICE

CERTIFICATE OF CORRECTION

PATENT NO. : 4,830,103

DATED : May 16, 1989

INVENTOR(S) : Henry W. Blackwell et al.

It is certified that error appears in the above-identified patent and that said Letters Patent is hereby corrected as shown below:

Column 11, line 51, Claim 9, line 3, "attached" should read -- attachable --.

Signed and Sealed this

Twenty-fourth Day of October, 1989

*Attest:*

DONALD J. QUIGG

*Attesting Officer*

*Commissioner of Patents and Trademarks*